US010501921B2

(12) United States Patent
Leng

(10) Patent No.: US 10,501,921 B2
(45) Date of Patent: Dec. 10, 2019

(54) TOILET AND FLUSHING CONTROL METHOD THEREOF

(71) Applicant: BOE TECHNOLOGY GROUP CO., LTD., Beijing (CN)

(72) Inventor: Changlin Leng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 45 days.

(21) Appl. No.: 15/812,132

(22) Filed: Nov. 14, 2017

(65) Prior Publication Data

US 2018/0258625 A1 Sep. 13, 2018

(30) Foreign Application Priority Data

Mar. 8, 2017 (CN) ..... 2017 1 0136359

(51) Int. Cl.

| | |
|---|---|
| ***E03D 9/00*** | (2006.01) |
| ***E03D 5/10*** | (2006.01) |
| ***B05B 12/12*** | (2006.01) |
| ***E03D 11/11*** | (2006.01) |
| ***B05B 15/70*** | (2018.01) |

(52) U.S. Cl.

CPC ..... *E03D 9/002* (2013.01); *B05B 12/122* (2013.01); *B05B 15/70* (2018.02); *E03D 5/105* (2013.01); *E03D 11/11* (2013.01)

(58) Field of Classification Search

CPC ..... E03D 9/002
USPC ..... 4/223–233
See application file for complete search history.

(56) References Cited

U.S. PATENT DOCUMENTS

| | | | | |
|---|---|---|---|---|
| 6,745,417 | B2 * | 6/2004 | Sumino | A47K 13/10 4/222 |
| 10,183,308 | B2 * | 1/2019 | Choi | B05B 15/70 |
| 2010/0146691 | A1 * | 6/2010 | Chan | E03D 5/105 4/313 |

FOREIGN PATENT DOCUMENTS

| | | | |
|---|---|---|---|
| CN | 102979155 | A | 3/2013 |
| CN | 104790484 | A | 7/2015 |
| ES | 2510190 | A | 10/2014 |

OTHER PUBLICATIONS

First Office Action for Chinese Application No. 201710136359.5, dated Sep. 12, 2018, 7 pages.

* cited by examiner

*Primary Examiner* — Christine J Skubinna
(74) *Attorney, Agent, or Firm* — Brooks Kushman P.C.

(57) ABSTRACT

The present disclosure provides a toilet and a flushing control method thereof. The toilet includes a toilet bowl, a toilet lid, a water tank, at least one image collector, at least one sprayer, and a controller. The toilet lid is arranged on the toilet bowl, the controller is arranged at any one of the toilet bowl, the toilet lid and the water tank, the image collector is arranged at a surface of the toilet lid facing the toilet bowl and communicatively connected to the controller, and the sprayer is movably arranged at the surface of the toilet lid facing the toilet bowl, connected to the water tank and communicatively connected to the controller.

16 Claims, 4 Drawing Sheets

TOILET AND FLUSHING CONTROL METHOD THEREOF

CROSS-REFERENCE TO RELATED APPLICATION

This application claims priority to Chinese Patent Application No. 201710136359.5 filed on Mar. 8, 2017, which is incorporated herein by reference in its entirety.

TECHNICAL FIELD

The present disclosure relates to the field of bathroom accessories, in particular to a toilet and a flushing control method thereof.

BACKGROUND

In the related art, in the case of flushing a toilet, usually contamination may not be removed completely due to such reasons as hydraulic pressure, or the toilet needs to be flushed for many times, so as to remove the contamination completely, resulting in a waste of water.

SUMMARY

An object of the present disclosure is to provide a toilet and a flushing control method thereof, so as to completely remove the contamination in the toilet and save water.

In one aspect, the present disclosure provides in some embodiments a toilet, including: a toilet bowl; a toilet lid covering the toilet bowl; a water tank; a controller arranged at any one of the toilet bowl the toilet lid and the water tank; at least one image collector arranged at a surface of the toilet lid facing the toilet bowl and communicatively connected to the controller; and at least one sprayer movably arranged at the surface of the toilet lid facing the toilet bowl, connected to the water tank and communicatively connected to the controller.

According to the toilet in the embodiments of the present disclosure, the image collector, the controller and the sprayer are arranged at the surface of the toilet lid facing the toilet bowl. The image collector captures an image of an interior of the toilet bowl, and compares the captured image with a standard image. In the case that the image captured by the image collector is different from the standard image, the control acquires a position of coordinates of contamination according to the difference between the image captured by the image collector and the standard image, and control the sprayer to move to a corresponding position and spray water onto the contamination, so as to remove the contamination. As a result, it is able to completely remove the contamination in the toilet bowl through the sprayer.

In a possible embodiment of the present disclosure, a guiding rail is arranged at the surface of the toilet lid facing the toilet bowl, and the sprayer is movably arranged on the guiding rail.

In a possible embodiment of the present disclosure, the guiding rail includes: a first guiding rail arranged at the surface of the toilet lid facing the toilet bowl; and a second guiding rail movably arranged on the first guiding rail and extending in a direction deviated from an extension direction of the first guiding rail. The sprayer is movably arranged on the second guiding rail.

In a possible embodiment of the present disclosure, the first guiding rail and the second guiding rail are each of a straight line form and perpendicular to each other.

In a possible embodiment of the present disclosure, the sprayer is rotatably arranged on the toilet lid.

In a possible embodiment of the present disclosure, the sprayer is capable of rotating relative to a direction perpendicular to the toilet lid at an angle of $\alpha$, and $0° \leq \alpha < 90°$.

In a possible embodiment of the present disclosure, $0° \leq \alpha \leq 45°$.

In a possible embodiment of the present disclosure, the image collector is arranged at a center of the surface of the toilet lid facing the toilet bowl.

In a possible embodiment of the present disclosure, there is a plurality of sprayers arranged at the surface of the toilet lid facing the toilet bowl and spaced apart from each other.

In a possible embodiment of the present disclosure, the sprayer is a high-pressure water nozzle capable of spraying water at a pressure of $\sigma$, and $1.0\ \text{MPa} \leq \sigma \leq 2.5\ \text{MPa}$.

In a possible embodiment of the present disclosure, the water tank includes a first water tank and a second water tank separated from the first water tank, the first water tank is in direct communication with an interior of the toilet bowl, and the sprayer is in communication with the second water tank through a pipe.

In a possible embodiment of the present disclosure, the image collector is movably arranged on the toilet lid.

In a possible embodiment of the present disclosure, the image collector is configured to, after flushing the toilet, capture an image of the interior of the toilet bowl and transmit the captured image to the controller.

In a possible embodiment of the present disclosure, the controller is configured to: receive the captured image from the image collector; compare the captured image with a standard image so as to determine whether or not the captured image is different from the standard image; and in the case that the captured image is different from the standard image, determine that contamination exists in the toilet bowl, determine a position of coordinates of the contamination in the toilet bowl according to the difference, and control the sprayer to move and spray water onto the contamination, so as to remove the contamination.

In a possible embodiment of the present disclosure, the standard image is pre-stored in the controller.

In another aspect, the present disclosure provides in some embodiments a flushing control method for the toilet, including steps of: capturing, by an image collector, an image of an interior of the toilet; transmitting, by the image collector, the captured image to the controller, and determining, by the controller, whether or not the captured image is different from a standard image; in the case that the captured image is different from the standard image, controlling, by the controller, a sprayer to move and spray water to the interior of the toilet bowl; and in the case that the captured image is identical to the standard image, determining that contamination in the interior of the toilet has been removed.

The other aspects and the advantages of the present disclosure will be given as follows, or will become more apparent, or will be understood through practices.

BRIEF DESCRIPTION OF THE DRAWINGS

In order to illustrate the technical solutions of the present disclosure in a clearer manner, the drawings desired for the present disclosure will be described hereinafter briefly. Obviously, the following drawings merely relate to some embodiments of the present disclosure, and based on these drawings, a person skilled in the art may obtain the other drawings without any creative effort.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

In the following, a toilet 100 will be illustrated in view of FIGS. 1-3 according to the embodiments of the present disclosure.

Figure 1:
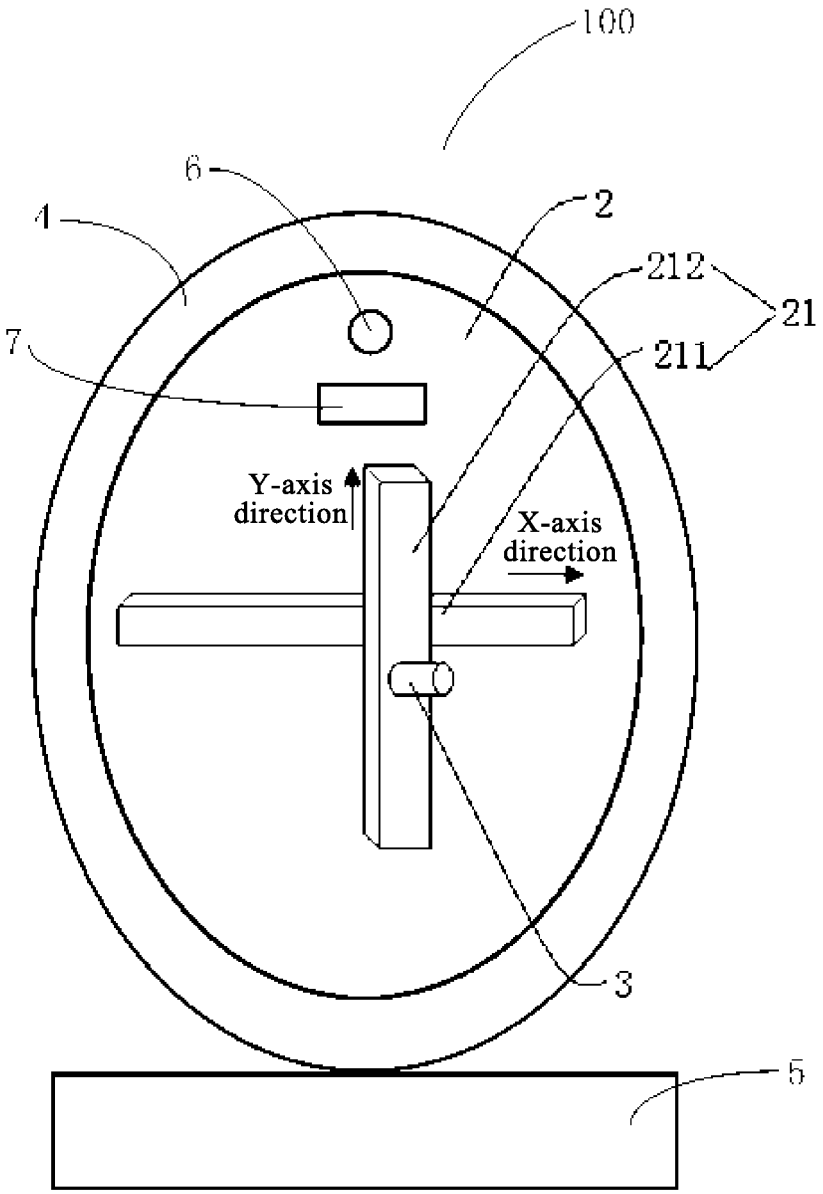
FIG. 1 is a schematic view showing a toilet lid according to one embodiment of the present disclosure.

The present disclosure provides in some embodiments the toilet 100 which, as shown in FIG. 1, includes a toilet bowl 4, a toilet lid 2, a water tank 5, at least one image collector 6, at least one sprayer 3 and a controller 7.

It should be appreciated that, the so-called "image collector" may be a device merely having a function of capturing an image, or a device merely having a function of recording a video, or a device having both of the functions. In addition, unless otherwise defined, the phrase "a plurality of" refers to two or more.

The toilet lid 2 is arranged on the toilet bowl 4, and it may be used to cover or expose the toilet bowl 4. For example, in a possible embodiment of the present disclosure, the toilet lid 2 may be arranged on the toilet bowl 4 in a flip-flap manner. To be specific, one end of the toilet lid 2 may be connected to the toilet bowl 4 through a hinge, a pivot or the like, and the other end may be used to facilitate the covering or exposing of the toilet bowl 4. In this way, it is able to reliably connect the toilet lid 2 to the toilet bowl 4 and facilitate the use thereof.

The water tank 5 is in communication with an interior of the toilet bowl 4. In FIG. 1, the controller 7 is arranged on the toilet lid 2. However, the controller 7 may also be arranged on the toilet bowl 4 or the water tank 5. The image collector 6 is arranged at a surface of the toilet lid 2 facing the toilet bowl 4 (e.g., a lower surface of the toilet lid 2 in the case that the toilet 2 covers the toilet bowl 4), and communicatively connected to the controller 7. The sprayer 3 is movably arranged at the surface of the toilet lid 2 facing the toilet set 4, connected to the water tank 5, and communicatively connected to the controller 7.

The image collector 6 may capture an image (e.g., picture or video) of the interior of the toilet bowl, and the captured image may be compared with the standard image.

For example, a user may cover the toilet bowl 4 with the toilet lid 2 after use, so that the lower surface of the toilet lid 2 faces the toilet bowl 4. Then, the toilet may be flushed normally. Next, the image collector 6 may capture an image of the interior of the toilet bowl, and transmit the captured image to the controller 7. The controller 7 may compare the captured image with the standard image. In the case that the image from the image collector 6 is identical to the standard image, it means that the toilet 100 has been flushed successfully and the toilet bowl 4 is clean, and in the case that the image from the image collector 6 is different from the standard image, it means that the contamination still exists in the toilet 100. At this time, the controller 7 may acquire a position of coordinates of the contamination according to the difference between the image from the image collector 6 and the standard image, so as to control the sprayer 3 to move and spray water onto the contamination, thereby to remove the contamination. The standard image may be pre-stored in the controller 7. In this way, it is able to completely remove the contamination in the toilet bowl 4 through the sprayer 3 as compared with the related art where the contamination cannot be removed completely due to such reasons such insufficient hydraulic pressure or a waste of water exists due to repeated flushing operations, thereby to improve the flushing performance of the toilet 100, save water and reduce the cost of using the toilet 100.

It should be appreciated that, the so-called "flushing normally" refers to a conventional flushing operation for the toilet, e.g., a single flushing operation.

According to the toilet 100 in the embodiments of the present disclosure, the image collector 6, the controller 7 and the sprayer 3 are arranged at the surface of the toilet lid 2 facing the toilet bowl 4. The image collector 6 captures an image of the interior of the toilet bowl, and the captured image is compared with the standard image. In the case that the image from the image collector 6 is different from the standard image, the controller 7 may acquire the position of coordinates of the contamination according to the difference between the captured image and the standard image, and control the sprayer 3 to move to a corresponding position, so as to enable the sprayer to spray water onto the contamination, thereby to remove the contamination. As a result, it is able to completely remove the contamination in the toilet bowl 4 through the sprayer 3 as compared with the related art where the contamination cannot be removed completely due to such reasons such insufficient hydraulic pressure or a waste of water exists due to repeated flushing operations, thereby to improve the flushing performance of the toilet 100, save water and reduce the cost of using the toilet 100. In addition, it is unnecessary to remove the contamination in the toilet manually, thereby to facilitate the use of the toilet.

In a possible embodiment of the present disclosure, a driving mechanism (not shown), e.g., an electric motor, may be arranged on the sprayer 3 so as to drive the sprayer 3 to move. The driving mechanism may be provided with a control unit communicatively connected to the controller 7, and a signal may be transmitted by the controller 7 to the control unit, so as to enable the control unit to control the sprayer 3 to move on the surface of the toilet lid 2 facing the toilet bowl 4.

In a possible embodiment of the present disclosure, a guiding rail 21 is arranged at the surface of the toilet lid 2 facing the toilet bowl 4, and the sprayer 3 is movably arranged on the guiding rail 21. In this way, it is able for the sprayer 3 to stably and reliably move on the toilet lid 2, thereby to remove the contamination in the toilet bowl 4 in an accurate and complete manner through the sprayer 3.

Figure 2:
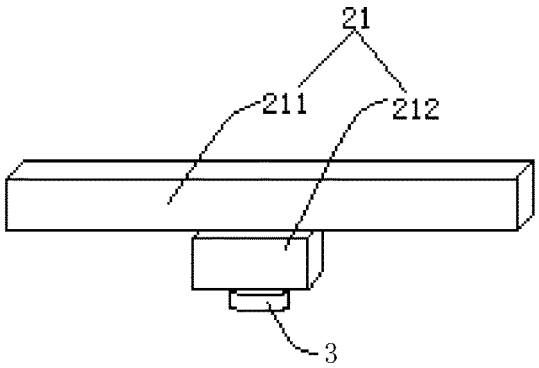
FIG. 2 is a schematic view showing a guiding rail according to one embodiment of the present disclosure.

To be specific, as shown in FIGS. 1 and 2, the guiding rail 21 includes a first guiding rail 211 and a second guiding rail 212. The first guiding rail 211 is arranged at the surface of the toilet lid 2 facing the toilet bowl 4, and the second guiding rail 212 is movably arranged on the first guiding rail 211 and extending in a direction deviated from an extension direction of the first guiding rail 211. The sprayer 3 is movably arranged on the second guiding rail 212. In other words, an extension direction of the second guiding rail 212 is different from the extension direction of the first guiding rail 211. In a possible embodiment of the present disclosure, the first guiding rail 211 and the second guiding rail 212 may each be of a curved, straight or folded line form.

For example, in some embodiments of the present disclosure, the first guiding rail 211 and the second guiding rail 212 may each be of a straight line form and cross each other. In other words, an orthogonal projection of the first guiding rail 211 onto the toilet lid 2 crosses an orthogonal projection of the second guiding rail 212 onto the toilet lid 2. The second guiding rail 212 may be connected to a side of the first guiding rail 211 away from the toilet lid 2. In this way, it is able to, with a simple and delicate structure, move the sprayer 3 on the two-dimensional surface of the toilet lid 2 by controlling the movement of the sprayer 3 and the second guiding rail 212, thereby to completely flush the toilet bowl 4 in all directions through the sprayer 3 in an easy manner, and save the water. In addition, it is unnecessary to remove the contamination in the toilet bowl 4 manually, thereby to reduce the difficulty in cleaning the toilet 100 and facilitate the use thereof.

In a possible embodiment of the present disclosure, the first guiding rail 211 and the second guiding rail 212 may be each of a straight line form and arranged perpendicular to each other. At this time, one of the first guiding rail 211 and the second guiding rail 212 may be defined as an X-axis, the other may be defined as a Y-axis, and a midpoint of the first guiding rail 211 may be defined as an origin of a resultant coordinate system in a two-dimensional plane. In this way, through controlling the movement of the sprayer 3 and the second guiding rail 212, it is able to move the sprayer 3 on the two-dimensional surface of the toilet lid 2 randomly to a position corresponding to the contamination, thereby to completely flush the toilet in all directions and remove the contamination accurately. In addition, it is able to simplify a manufacture process of the guiding rail 211, thereby to reduce the manufacture cost.

For example, in a possible embodiment of the present disclosure, the toilet lid 2 may be of an elliptical shape, the extension direction of the first guiding rail 211 may be identical to an extension direction of a short axis of the toilet lid 2 (i.e., a left-right direction in FIG. 2), and the extension direction of the second guiding rail 212 may be identical to an extension direction of a long axis of the toilet lid 2 (e.g., an up-down direction in FIG. 2). In a possible embodiment of the present disclosure, the first guiding rail 211 may pass through a center of the toilet lid 2, with the midpoint of the first guiding rail 211 coinciding with the center of the toilet lid 2. At this time, the first guiding rail 211 may be defined as the X-axis of the coordinate system, the second guiding rail 212 may be defined as the Y-axis of the coordinate system, and the center of the toilet lid 2 may be defined as the origin of the coordinate system.

It should be appreciated that, the so-called "elliptical shape" shall be understood in general, i.e., it is unnecessary for the "elliptical shape" to be a proper elliptical shape.

Figure 4:
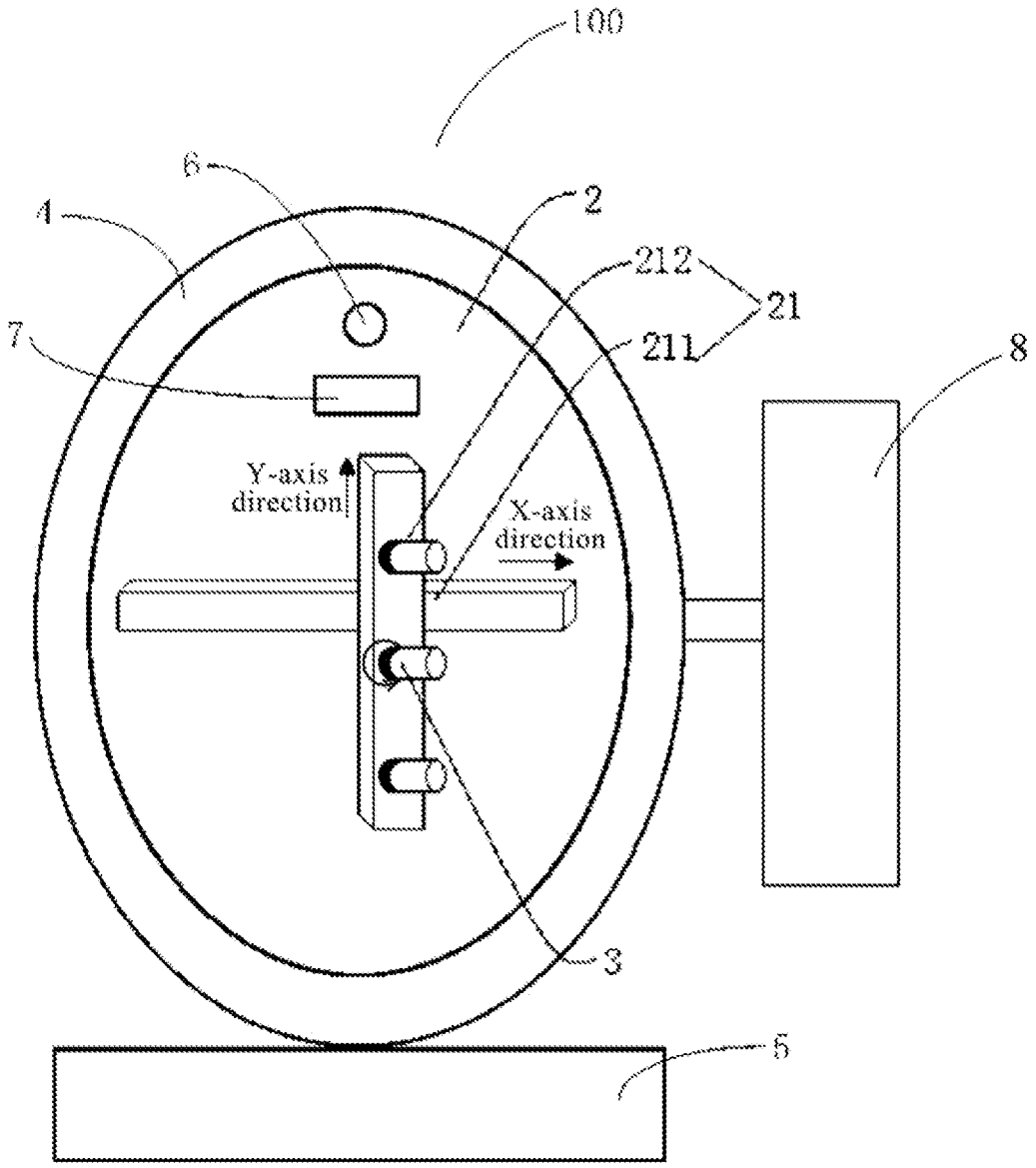
FIG. 4 is a schematic view showing a toilet lid according to another embodiment.

In some embodiments of the present disclosure, as shown in FIG. 4, the sprayer 3 is rotatably arranged on the toilet lid 2. In this way, during the flushing, the sprayer 3 may be rotated, so as to enable the sprayer 3 to wash the contamination in the toilet bowl 4 in all directions, improve the spraying accuracy of the sprayer 3 and enlarge a spraying range of the sprayer 3 without a blind angle, thereby to enable the sprayer 3 to completely remove the contamination at any position in the toilet bowl 4 quickly and conveniently, and reduce the difficulty in cleaning the toilet 100. In addition, it is able to further save the water with a simple, conveniently-implemented structure.

For example, in the case that the contamination exists in the toilet bowl 4, the controller 7 may control the sprayer 3 to rotate, so as to enable the sprayer 3 to be aligned with the contamination and spray water onto the contamination to remove the contamination. In a possible embodiment of the present disclosure, the controller 7 may control the sprayer 3 to move to a position in proximity to the contamination, and then rotate the sprayer 3 by a certain angle, so as to enable the sprayer 3 to be aligned with the contamination and spray water onto the contamination to remove the contamination.

Figure 5:
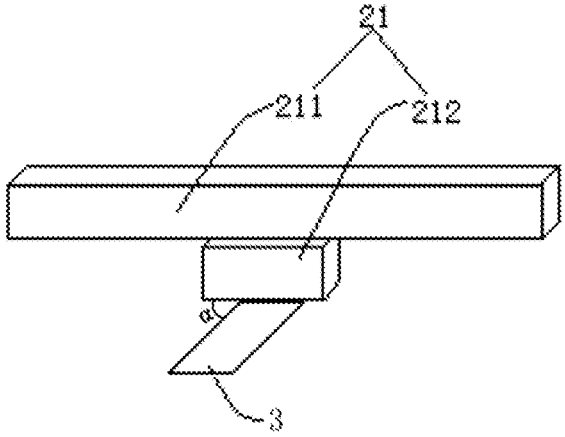
FIG. 5 is a schematic view showing a guiding rail according to another embodiment of the present disclosure.

To be specific, as shown in FIG. 5, the sprayer 3 is capable of rotating relative to a direction perpendicular to the toilet lid 2 at an angle of $\alpha$, and $0° \leq \alpha < 90°$. In other words, an angle between a spraying direction of the sprayer 3 and the direction perpendicular to the toilet lid 2 is a. In this way, it is able for the sprayer 3 to spray water into the toilet bowl 4 in all directions without the blind angle.

In a possible embodiment of the present disclosure, $0° \leq \alpha \leq 45°$. In this way, it is able to simplify a structure of the sprayer 3 while removing the contamination in the toilet bowl 4 in all directions, thereby to improve the reliability of the sprayer 3, prolong its service life and reduce the manufacture cost.

In some embodiments of the present disclosure, the image collector is arranged at a center of the surface of the toilet lid 2 facing the toilet bowl 4. It should be appreciated that, the word "center" shall be understood in general, i.e., the image collector may not be located strictly at a center of the surface of the toilet lid 2 facing the toilet bowl 4. In this way, it is able for the image collector to capture an image of the interior of the toilet in all directions without the blind angle, thereby to acquire the positions (e.g., coordinates) of all the contamination in the toilet and completely remove the contamination in the toilet bowl 4.

Figure 6:
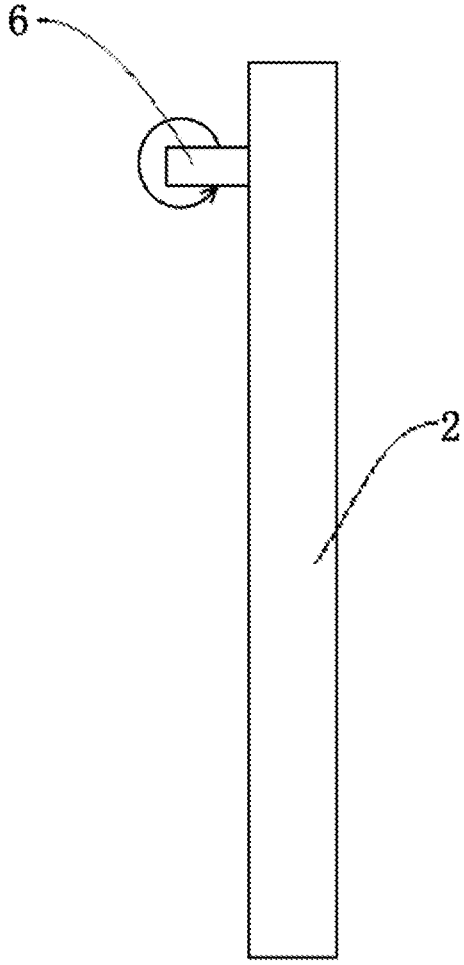
FIG. 6 is a schematic view of an image collector rotatably arranged on a toilet lid according to one embodiment of the present disclosure.

In some other embodiments of the present disclosure, as shown in FIG. 6, the image collector is rotatably arranged on the toilet lid 2. At this time, the image collector may be arranged at the center of the surface of the toilet lid 2 facing the toilet bowl 4, or at any other position. In this way, it enables to rotate the image collector to capture an image of the interior of the toilet bowl 4 in all directions without the blind angle, thereby to acquire the positions of all the contamination in the toilet bowl 4 and completely remove the contamination in the toilet bowl 4.

In some embodiments of the present disclosure, as shown in FIG. 4 there is a plurality of sprayers 3 arranged at the surface of the toilet lid 2 facing the toilet bowl 4 and spaced apart from each other. In a possible embodiment of the present disclosure, the sprayers are arranged on the surface of the toilet lid 2 facing the toilet bowl 4 and spaced apart from each other at a regular interval. In use, the controller 7 may control the sprayers to spray onto the contamination at the same time to remove the contamination, so as to shorten the time period for the removal of the contamination, improve the flushing efficiency and the flushing effect, and remove the contamination completely.

It should be appreciated that, the controller 7 may also move one of the sprayers adjacent to the contamination according to the position of the contamination, so as to enable the sprayer adjacent to the contamination to spray onto the contamination. At this time, the other sprayers may spray water onto the contamination in an auxiliary manner or may not operate. In this way, it is able to reduce a movement distance and a movement time period of the sprayers, thereby to reduce the entire flushing time period, and improve the flushing efficiency and the flushing effect.

In some embodiments of the present disclosure, the sprayer 3 is a high-pressure water nozzle capable of spraying water at a pressure of $\sigma$, and 1.0 MPa$\leq\sigma\leq$2.5 MPa. The pressure may be set according to a type of the toilet 100, and thus will not be particularly defined herein. For example, the pressure of $\sigma$ may be 1.0 MPa, 1.5 MPa, 2.0 MPa or 2.5 MPa. In this way, it is able for the sprayer 3 to spray the water at a certain pressure onto the contamination in the toilet bowl 4, so as to completely remove the contamination in the toilet bowl 4.

In some embodiments of the present disclosure, as shown in FIG. 4, the water may include a first water tank 5 and a second water tank 8 separated from the first water tank, the first water tank is in direct communication with an interior of the toilet bowl 4, and the sprayer 3 is in communication with the second water tank through a pipe. For example, the water in the first water tank may be used for flushing the toilet bowl 4 normally, while the water in the second water tank may be used for removing the remaining contamination in the toilet bowl 4. In this way, it is able to independently provide the water for the normal flushing operation and the water for the sprayer 3, thereby to prevent the occurrence of such a circumstance where the spraying operation of the sprayer is adversely affected in the case that insufficient water remains in the water tank after the normal flushing operation and before the water tank is refilled, so as to improve the reliability of the toilet 100.

In a possible embodiment of the present disclosure, the pipe may pass through the toilet lid 2 and connected to the sprayer 3, but the present disclosure is not limited thereto. It should be appreciated that, it is unnecessary for the pipe to pass through the toilet lid 2, as long as the second water tank is capable of being in communication with the sprayer 3 through the pipe.

According to the toilet 100 in the embodiments of the present disclosure, it is able to solve the problem in the related art where the contamination in the toilet cannot be removed completely due to such reasons as insufficient hydraulic pressure or a waste of water exists due to repeated flushing operations, thereby to improve the flushing performance of the toilet and reduce the cost of using the toilet 100. In addition, it is unnecessary to remove the contamination in the toilet manually, so as to facilitate the use thereof.

Figure 3:
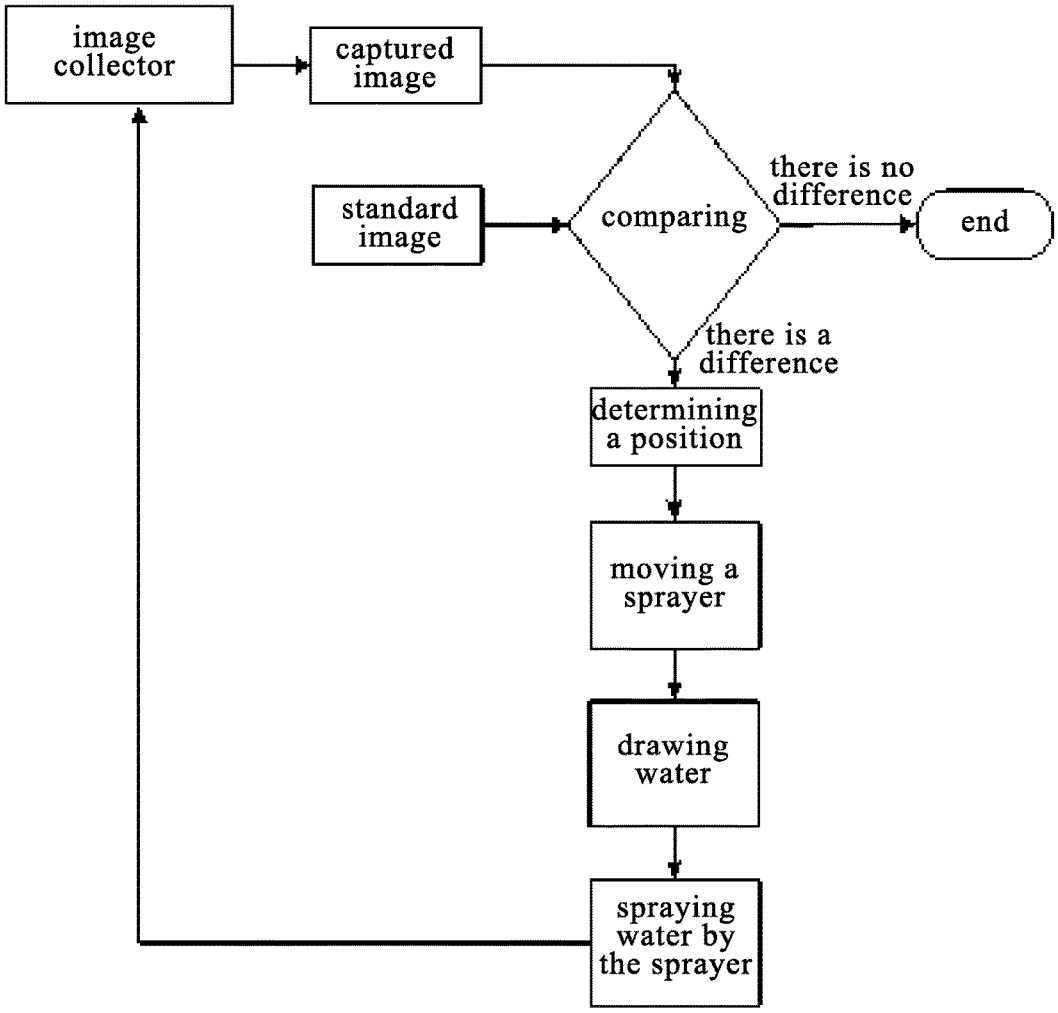
FIG. 3 is a flow chart of a flushing control method for a toilet according to one embodiment of the present disclosure.

The present disclosure further provides in some embodiments a flushing control method for the toilet 100 which, as shown in FIG. 3 in conjunction with FIG. 1, includes steps of: capturing, by the image collector 6, an image of the interior of the toilet; transmitting, by the image collector 6, the captured image to the controller 7, and determining, by the controller 7, whether or not the captured image is different from the standard image; in the case that the captured image is different from the standard image, controlling, by the controller 7, the sprayer 3 to move and spray water to the interior of the toilet bowl 4; and in the case that the captured image is identical to the standard image, determining that contamination in the interior of the toilet bowl has been removed.

To be specific, after use or after the normal flushing operation of the toilet 100, the image collector 6 may capture an image of the interior of the toilet bowl 4, and transmit the captured image to the controller 7. The controller 7 may compare and analyze the captured image with the standard image, and determine whether or not the captured image is different from the standard image. In the case that the captured image is different from the standard image, it means that the contamination exists in the toilet bowl, and the controller 7 may acquire the position of coordinates of the contamination according to the difference between the captured image and the standard image, and control the sprayer 3 to move and spray water onto the contamination in the toilet bowl 4, so as to remove the contamination. In the case that the captured image is identical to the standard image, it means that the toilet 100 has been flushed completely, and the control process ends.

According to the flushing control method in the embodiments of the present disclosure, it is able to completely remove the contamination in the toilet bowl 4 through the sprayer 3 spraying water onto the contamination in the toilet bowl 4, so as to solve the problem in the related art where the contamination in the toilet bowl cannot be removed completely due to such reasons as insufficient hydraulic pressure or a waste of water exists due to repeated flushing operations, thereby to improve the flushing performance of the toilet, save water, and reduce the cost of using the toilet.

According to the flushing control method for the toilet 100 in the embodiments of the present disclosure, the image collector 6 captures an image of the interior of the toilet bowl 4, and the captured image is compared with the standard image so as to determine whether or not the contamination exists in the toilet bowl 4. In the case that the contamination exists in the toilet bowl 4, the controller 7 may acquire the position of coordinates of the contamination according to the difference between the captured image from the image collector 6 and the standard image, and control the sprayer 3 to move to a corresponding position and spray water onto the contamination in the toilet bowl 4, so as to remove the contamination. As a result, it is able to completely remove the contamination in the toilet bowl 4 through the sprayer 3, so as to solve the problem in the related art where the contamination in the toilet bowl cannot be removed completely due to such reasons as insufficient hydraulic pressure or a waste of water exists due to repeated flushing operations, thereby to improve the flushing performance of the toilet, save water and reduce the cost of using the toilet. In addition, it is unnecessary to remove the contamination in the toilet manually, thereby to facilitate the use thereof.

In the above description, such phrases as "an embodiment", "one embodiment", "some embodiments", "e.g." and "for example" are intended to illustrate that features, structures, materials or characteristics are included in at least one embodiment or example of the present disclosure, and these phrases do not necessarily refer to an identical embodiment or example. In addition, the features, structures, materials or characteristics may be combined in an appropriate manner in one or more embodiments or examples.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A toilet, comprising:

a toilet bowl;

a toilet lid capable of covering the toilet bowl;

a water tank;

a controller arranged at any one of the toilet bowl, the toilet lid and the water tank;

at least one image collector arranged at a surface of the toilet lid facing the toilet bowl and communicatively connected to the controller; and at least one sprayer movably arranged at the surface of the toilet lid facing the toilet bowl, connected to the water tank and communicatively connected to the controller, wherein a guiding rail is arranged at the surface of the toilet lid facing the toilet bowl, and the sprayer is movably arranged on the guiding rail.

2. The toilet according to claim 1, wherein the guiding rail comprises:

a first guiding rail arranged at the surface of the toilet lid facing the toilet bowl; and a second guiding rail movably arranged on the first guiding rail and extending in a direction deviated from an extension direction of the first guiding rail, wherein the sprayer is movably arranged on the second guiding rail.

3. The toilet according to claim 2, wherein the first guiding rail and the second guiding rail are each of a straight line form and perpendicular to each other.

4. The toilet according to claim 1, wherein the sprayer is rotatably arranged on the toilet lid.

5. The toilet according to claim 4, wherein the sprayer is capable of rotating relative to a direction perpendicular to the toilet lid at an angle of $\alpha$, and $0° \leq \alpha < 90°$.

6. The toilet according to claim 5, wherein $0° \leq \alpha \leq 45°$.

7. The toilet according to claim 2, wherein the sprayer is rotatably arranged on the toilet lid.

8. The toilet according to claim 1, wherein the image collector is arranged at a center of the surface of the toilet lid facing the toilet bowl.

9. The toilet according to claim 1, wherein there is a plurality of sprayers arranged at the surface of the toilet lid facing the toilet bowl and spaced apart from each other.

10. The toilet according to claim 1, wherein the sprayer is a high-pressure water nozzle capable of spraying water at a pressure of $\sigma$, and $1.0\ \text{MPa} \leq \sigma \leq 2.5\ \text{MPa}$.

11. The toilet according to claim 1, wherein the water tank comprises a first water tank and a second water tank separated from the first water tank, the first water tank is in direct communication with an interior of the toilet bowl, and the sprayer is in communication with the second water tank through a pipe.

12. The toilet according to claim 1, wherein the image collector is movably arranged on the toilet lid.

13. The toilet according to claim 1, wherein the image collector is configured to, after the toilet is flushed, capturing an image of an interior of the toilet bowl, and transmit the captured image to the controller.

14. The toilet according to claim 13, wherein the controller is configured to:

receive the captured image from the image collector;

compare the captured image with a standard image to determine whether there is a difference between the captured image and the standard image; and in the case that there is the difference between the captured image and the standard image, determine that contamination exists in the toilet bowl, determine a position of the contamination in the toilet bowl according to the difference, to control the sprayer to move and spray water onto the contamination to remove the contamination.

15. The toilet according to claim 14, wherein the standard image is pre-stored in the controller.

16. A flushing control method for the toilet according to claim 1, comprising:

capturing, by the image collector, an image of an interior of the toilet;

transmitting, by the image collector, the captured image to the controller; and determining, by the controller, whether there is a difference between the captured image and a standard image;

in the case that there is the difference between the captured image and the standard image, controlling, by the controller, the sprayer to move and spray water into the interior of the toilet bowl; and in the case that there is no difference between the captured image and the standard image, determining that contamination in the interior of the toilet has been removed.

* * * * *